United States Patent [19]

Cook et al.

[11] 4,202,649

[45] May 13, 1980

[54] FRONT PLATE FOR TRENCH BOXES

[75] Inventors: John B. Cook; Melvin Pike, both of East Lansing, Mich.

[73] Assignee: Efficiency Production, Inc., Okemos, Mich.

[21] Appl. No.: 965,985

[22] Filed: Dec. 4, 1978

[51] Int. Cl.[2] ..... E21D 5/00

[52] U.S. Cl. ..... 405/282; 405/283

[58] Field of Search ..... 405/272, 282, 283; 52/657

[56] References Cited

U.S. PATENT DOCUMENTS

| | | | |
|---|---|---|---|
| 3,543,522 | 12/1970 | Torti | 405/283 |
| 3,912,407 | 10/1975 | Heininger | 52/657 |
| 3,992,887 | 11/1976 | Fisher | 52/727 |
| 4,090,365 | 5/1978 | Nieber | 405/282 |

*Primary Examiner*—Alexander Grosz

*Attorney, Agent, or Firm*—Miller, Morriss and Pappas

[57] ABSTRACT

A front plate for trench boxes located at one end of a rectangular trench box and attached between a pair of spaced apart adjacent trench box walls. The front plate has a chisel edge smooth skin bottom with means to achieve attachment of the front plate to adjacent trench box walls. Vertical and horizontal structural members are structurally interrelated and attach to the bottom and the bottom extends beneath the lowermost horizontal structural element and includes the bottom closure plate closing on a plurality of spaced apart gusset plates extending in vertical planes below the lowermost horizontal structural member.

4 Claims, 3 Drawing Figures

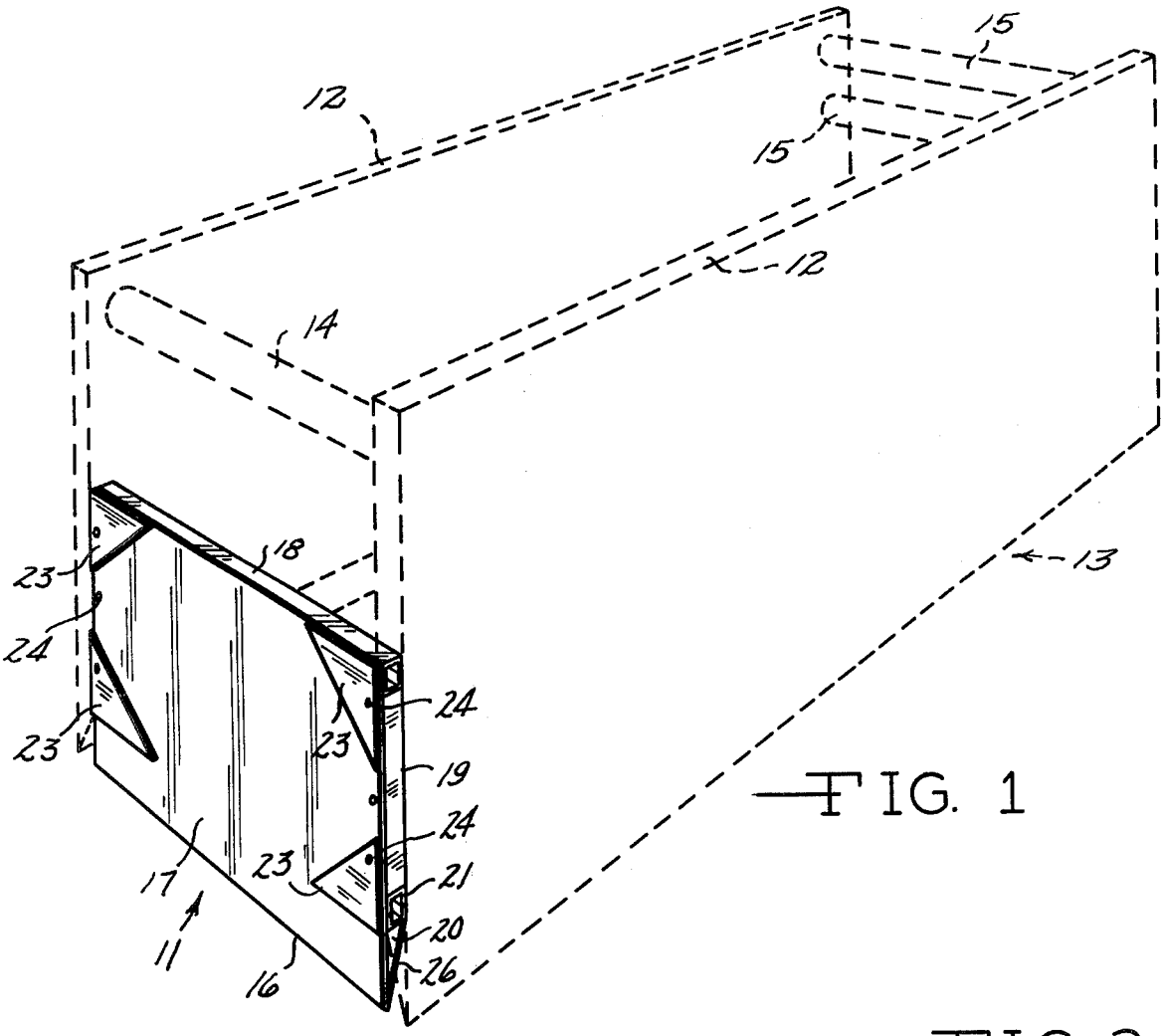
FIG. 1
FIG. 2
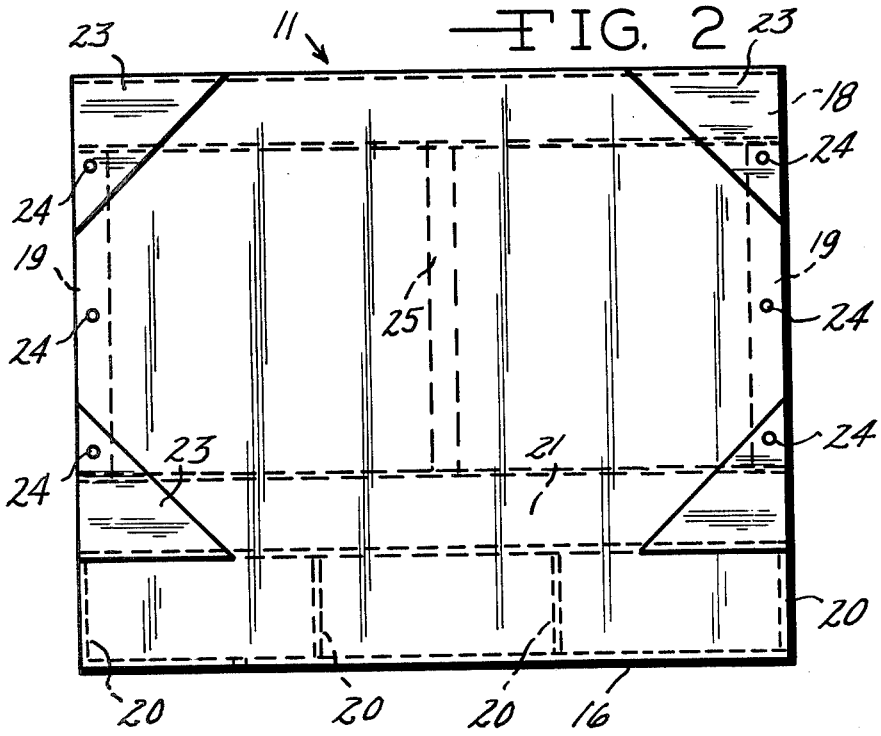
FIG. 3
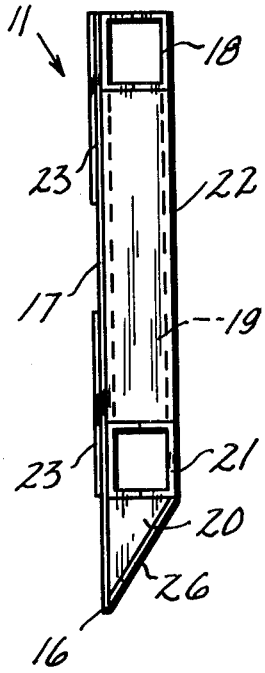

FRONT PLATE FOR TRENCH BOXES

BACKGROUND OF THE INVENTION

The present invention is a knife edged or chisel edged front plate for trench boxes, the knife edge allowing the front end of the trench box to penetrate earth, sand and debris while rigidly supporting and spacing the adjacent trench box walls from each other. By gripping the earth in penetration with the box, the entire box is stabilized.

Unlike prior art front plates which merely provided a barrier against cave-in intrusion of debris into the box, the present invention provides a smooth unbroken bottom with skin surfaces which assist penetration into the earth with the trench box and which assists in sealing the end of the box against entry of debris and water. This is a valuable function when the box is working, for example, in sand and water bearing strata. During the installation in the ground, the weight of the trench box and engagement of the knife edged front plate with the ground urges the front plate into the ground as the box itself drops in the trench opening. The knife edge on the front plate facilitates location and penetration with the box.

Prior art front plates were usually tubes coupled over shaft-like or tubular step extensions and pinned therethrough against withdrawal. These served as spacers between the sides of the box and where debris barriers were needed a plate was usually welded or fastened between the upper and lower tubes. The tubes met stiff resistance to extra penetration into the earth and there was a poor fit or closure of the make-shift plates against the sides of the box and the flooding-in or cascading-in of debris at the front corner was common in certain types of ground and particularly flowable ground. In the prior art structures the engagement of transverse struts or tubes with the earth applied strains to the trench box panels at the connections of tubes to panels. The prior art front plates with tubes is best shown in the U.S. Pat. No. 3,992,887 to Walter A. Fisher and large lower surface contact areas are seen in the front structurals of the U.S. Pat. No. 3,212,270 to O. H. Benintend. In the U.S. Pat. No. 4,090,365 of A. J. Nieber, the front plate included blunt structural horizontal elements and simple reinforced sheets welded between the structural elements.

Accordingly, the present invention is intended to solve the problem presented by such blunt front plates by providing a digging or shear-functioning earth penetrating bottom which vastly improves trench box performance in flowing ground. This is of substantial significance in a trench box system which is under constant relocation and repositioning as it continuously progresses to shore an open hole or trench as it progresses and with the hole or trench being filled behind it. A chisel edge is presented carrying the structural weight and thrust of the box and the smooth interior and exterior closure surfaces on the chisel edge are relatively smooth and unbroken in relation to the earth in avoidance of frictional resistance to ground penetration of the front plate and against removal while accomplishing a substantial seal of the box at the front against the intrusion of debris and water.

At least one panel skin is usually provided which is fastened to the structural support elements on the outside and may be an extension of the bottom closure panel. An inner skin may be applied to present a smooth inner surface rising from the chisel edged bottom. The object of the panel skins, where used, is to prevent intrusion of debris through the framing of the front panel. The front panel of the present invention also establishes a lineal fastening to the adjacent trench box panels in contrast to prior art "point" or "knuckle" fastening and thus rigidifies the trench box at the front.

Other objects including economy, rigidity improvement and rugged serviceability with good load conducting characteristics will be appreciated by those skilled in the art as the description proceeds.

General Description

In general, a new, useful and inventive knife edged front plate is the subject of the present invention. The front plate attaches to the front end of a trench box and between the spaced apart vertical walls or panels thereof to form a penetrating and gripping barrier against intrusion of earth, water and debris from the front. At the rear end of the trench box, the barrier is unneeded since the rear end usually includes elevated panel spacers which straddle or bridge high between the trench box panels in prevention of collapse but which allow work to progress in the box and the pipe, for example, to trail behind the trench box until fill is pressed into the opening behind the moving trench box on closing in the pipe, tubing, or culvert work.

The front plate of the present invention is thus positioned transverse of the wall panels of the trench box and is removably secured to each of the panels substantially at the leading or front edges. The fastening of front plate to panels is in a vertical line contact. The front plate includes a structural support grouping made up of horizontal structural members and vertical structural members and which may be covered on one or both sides by panel skins. The vertical and horizontal skeletal members are connected as by welding to each other and the lowermost horizontal member includes a plurality of depending spaced apart triangular shaped gusset members and the gusset members are in spaced apart parallel position and each in a vertical plane. These gusset members, when covered, provide rigid structural support for the knife edged bottom of the front plate. "Vertical " and "horizontal" as used herein has reference to the orientation in use shown in the FIG. 1. An outer vertical smooth skin may be applied over the vertical and horizontal structural skeletal members as shown and may depend to cover the outer edges of the gusset members. The outer skin where used is secured to the structural elements and gusset members as by welding and the outer skin, where used, extends to the lowermost apex of the gusset members. An inner skin may be also affixed as by welding to the structural skeleton and extends downward and in parallel registry to the outer skin stopping short of covering the gusset members. The gusset members then are closed in by a closure plate which is attached to the gusset plates and to the lower horizontal structural member and also closes on the outer vertical skin at the bottom. It will be appreciated that the outer vertical skin may extend upwardly only to cover the lower horizontal member or may extend fully to the upper horizontal member. Triangular frontal corner plates reinforce and stabilize the juncture as between vertical and horizontal elements and are secured in place as by welding. Fastener openings run through the vertical end structurals and the corner plates and skins, where used, to provide support for fasteners running through the front plate and thence through mounting plates, brackets or lugs fixed or secured to complement the vertical box elements along the leading edges of the trench box panels. The vertical edges of the front plate are reinforced by the in-line bracket attachment to the trench box panels. While other forms of fasteners or disconnects are available, the preferred fastening is through the openings, as illustrated, and thence to simple brackets as angles or channels fastened snuggly as by bolts and nuts through the preformed openings and secured to the trench box channels. The advantage is in better rigidity achieved by the connection of front plate to adjacent spaced apart trench box panels while performing the role of spreaders in an improved way. The front plates of the present invention are also easily removed for dismantling from the trench box when unneeded. Other forms of front plate may use the same mounting and fastening means and be substituted for the front plate of the present invention by using common brackets and fasteners.

As will be appreciated, the front plate of the present invention closes the front end of the trench box with a stabilizing wall or barrier and the lower knife edge is formed skeletally by the gusset members and covered by the outer skin and closure plate to provide a ground engaging earth penetrating shoe or bottom which utilizes the weight of the total box as a driving tamp applied at the digging edge. In use, this type of front plate is extremely effective in loose shifting earth and water supported sand. In mud type earths, the barrier is effective against water and gravel debris which would likely intrude into the trench.

In the Drawings

FIG. 1 shows a perspective view of a trench box in phantom line as usually employed in deep trench operations as, for example, in laying pipe and shows the front plate of the present invention in full line transversely between the trench box panels and with the chisel edge down.

FIG. 2 is a front elevation view of the front plate seen in FIG. 1 and the phantom lines reveal the interior skeletal structure.

FIG. 3 is an end elevation view of the front plate shown in FIG. 2.

Specific Description

Referring to the drawings and with first particularity to the FIG. 1, a preferred embodiment of the front plate 11, in accord with the present invention, is illustrated in the setting of its use transversely positioned between the spaced apart walls or panels 12 of the trench box 13 and the front plate 11 is located at the front end of the trench box 13 as shown. A commonly used tubular spreader element 14 is shown in supplemental upper spacing support of the box 13 and this is of assistance particularly where the trench boxes 13 are relatively deep. In the prior art, the usual type of front plates included several of these tubes 14 with or without a connecting web of steel or other metal. These prior art front plates resisted entry of the front end of the box 13 into earth thus tending to tilt the box 13 upward at the front and formed a poor barrier in loose ground and a poor water seal where the formation was water bearing. Typical bridge spreaders 15 are shown at the rear of the trench box. These rear spreaders 15 are high to provide working room astraddle tubing or pipe layed in the box and trailing rearwardly at the set grade for filling. In use it will be appreciated that the trench box 13 is inched forwardly by lifting the front plate end of the box 13 and sliding the trench box forwardly to a new position and then dropping the trench box 13. The present invention, as will be seen, causes penetration of the front plate 11 in the earth.

A chisel edge or knife edge bottom 16 characterizes the front plate 11 in forming a sharp edge or shoe which bites into the soil or earth maximizing the driving and earth penetrating effect of the weight of the box 13. The outer front or skin 17 of the front plate 11 as shown is smooth and runs from an upper structural horizontal element 18 to the chisel edge 16. The skin 17 is welded, as will be seen, to a structural skeletal support formed by stress bearing horizontals as 18 and vertical structural elements 19 and gusset plates 20 reinforcing the chisel edge 16. At least one lower horizontal structural element 21 is secured between the verticals 19 and between the outer skin 17 and an inner skin 22 (best seen in FIG. 3). Corner plates or brace plates 23 are located over the outer skin 17 and are fastened, as by welding, to the outer skin 17 and thence to the skeletal structure beneath the skin 17. Fastener openings 24 are in spaced apart vertical register along the edges of the front plate 11 and through the inner skeletal members 19 and through the corner plates 23. Bolts can be passed through the openings 24 to edge brackets such as angles or channels (not shown) and located at the front inner end of the trench box panels or walls 12. In some instances no full skin 17 is required as where the entry of debris at the front is not a problem. Then the skin 17 simply extends downward from the lower horizontal member 21 to the bottom 16 at the apex of the chisel edge. The inner skin 22 may also be omitted as desired and then, as will be seen, the bottom or chisel edge is formed by the closure plate 26 covering gusset plates 20 and closing on the bottom edge of front skin 17.

In FIG. 2 an intermediate vertical structural member 25 is shown between the upper horizontal structural element 18 and the lower horizontal structural element 21. The intermediate vertical elements 25 are welded to the horizontal elements. Then the gusset members 20 are welded to depend, as shown, from the lower horizontal element 21 in plane frontal support of the outer skin 17 running down to the chisel edge 16.

From the FIGS. 1 and 3 it will best be appreciated that the inner skin 22 usually covers the uppermost horizontal structural element 18 and the lowermost horizontal structural element 21. Then the closure plate 26 is welded diagonally, as shown, from the lower horizontal element 21 to close against the bottom edge of the outer skin 17 at the knife edge or chisel edge 16 and is secured thereto as by welding to the gusset members 20.

The outer face of the chisel edge 16 at the apex between the closure plate 26 and the outer skin 17 is smooth except for the corner plates 23 which project outward from the skin 17 only for the thickness of the corner plates 23. This materially reduces resistance to friction and abrasion at the front face of the front plate 11 and the chisel edge 16 transmits all vertical thrust components based on box weight and stresses raised by tamping to achieve earth penetration and assure proper seating of the box 13 in loose ground with good seal and in avoidance of frontal entry of debris.

In general, all parts of the front plate 11 are made from metals which are preferably steel or aluminum and sometimes combinations thereof. The steel gives excellent strength but results in a heavy front plate 11. The steel is also subject to rusting in the environment of trenching work. The aluminum resists severe rust but is more prone to abrasive damage and deformation. The structural and skeletal inner members 18, 19, 21 and 25 are high strength. structural shapes and are preferably hollow shapes as seen in the square or rectangular tubing of elements 18 and 21. Actual tubing may be used or channels may be placed in face-to-face or flange-to-flange relation and welded at the seams to provide a hollow core construction.

As is well known in the trench box construction, wood filler strips may be inserted for the entire length of the hollow structurals. While this increases weight, the wood in some instances reduces the complete deformation of the upper horizontal structural members. Further, the entire front plate 11 may be filled during construction with closed cell plastic foam material such as styrene, urethane and the like which has the benefit of resisting the intrusion of mud, water and sediment which might otherwise fill the box elements and seriously increase the weight of the front plate 11. The closed cell foamed material, where desired, may be inserted in-situ and cured in place or foam blocks may be cut and fitted into the voids of the front plate before finally closing down the inner skin 22 or closing the structure. Final welding does not appear to seriously damage the lightweight foam filler.

In use, the front plate 11 is simply secured between the side panels 12 of a trench box 13 at the front end of the trench box 13 in replacement of simple tubular spreaders such as 14. This steadies the trench box 13 which is lowered into an earth opening or trench. The weight of the box 13 sinks the front plate 11 into the opening and the chisel edge 16 of the front plate 11 applies the weight of the trench box 13 to the earth assuring a good bite into the earth with an excellent seal against flowing debris such as sand, mud and water. In general, trench boxes 13 employing the front plate 11 tend to seek a level position in the earth rather than riding up at the front because of the penetration of the plate 11. The front plate 11 also provides a good barrier against the movement of debris from the front end and into the trench box 13 in interference with trench work proceeding therein.

Having thus disclosed our invention and the best mode of construction, those skilled in the art will appreciate improvements, modifications and changes and such improvements, modifications and changes are intended to be included in the spirit of the present invention limited only by the scope of our hereinafter appended claims.

We claim:

1. A front plate for trench boxes for location between a pair of elongate trench box panels at one end thereof and transverse between said panels, the combination including:

an upper horizontal structural shape member;

a lower horizontal structural shape member;

a plurality of vertical structural members between said horizontal structural members and against which said vertical structural members bear;

a plurality of triangularly shaped gusset members in spaced apart registry secured and depending from to the lower edge of said lower horizontal member;

an outer skin secured to said horizontal, said vertical and said gusset members in a plane relation and extending to the lowermost apex of said gusset member; and a closure plate closing on said gusset members and connecting with said lower horizontal member and said outer skin at the bottom thereof.

2. The front plate for trench boxes as defined in claim 1 wherein triangular corner plates are fastened to said outer skin at the perimeter juncture of said vertical and horizontal structural members.

3. The front plate for trench boxes as defined in claim 1 wherein the outermost of said vertical structural elements define a plurality of vertically disposed mounting fastener openings.

4. A front plate for trench boxes for transverse location between, and attachment to, a pair of spaced apart elongate trench box panels at one end thereof, the combination comprising:

an upper horizontal hollow section structural shape member;

a lower horizontal hollow section structural shape member in spaced apart registry with said upper horizontal structural shape member;

a plurality of vertical structural members between said horizontal structural members and bearing against said horizontal structural members and secured thereto;

an outer skin secured to at least one of said horizontal members and covering the grid formed by said vertical and horizontal structural members in a plane relation and having a bottom edge extending below said lower horizontal hollow section structural shape member;

a plurality of triangular shaped gusset plates secured to said lowermost horizontal structural member and depending therefrom and also secured to said outer skin extending below said lower horizontal structural member;

a closure plate closing against said lowermost horizontal member and secured thereto and extending downwardly to reinforcing contact with said vertical outer skin and secured thereto at said bottom edge;

four corner plates in triangular form secured along one edge to the outermost vertical structural elements and to the upper and lower horizontal structural section members; and fastener openings along the vertical edges of said front plate and through said vertical structural elements, said skin and some of said openings passing through said corner plates.

* * * * *

UNITED STATES PATENT OFFICE

CERTIFICATE OF CORRECTION

Patent No. 4,202,649 Dated 1980 May 13

Inventor(s) John B. Cook and Melvin Pike

It is certified that error appears in the above-identified patent and that said Letters Patent are hereby corrected as shown below:

Column 4, line 63, after "good" insert --- bottom ---

Column 5, line 5, delete the period after "strength"

Column 6, Claim 1, line 5, after "secured" insert --- to ---

Column 6, Claim 1, line 6, at the beginning of the line delete "to"

Signed and Sealed this

*Fifth* Day of *August 1980*

[SEAL]

*Attest:*

SIDNEY A. DIAMOND

*Attesting Officer*

*Commissioner of Patents and Trademarks*